United States Patent [19]

Quenneville et al.

[11] Patent Number: 4,760,380

[45] Date of Patent: Jul. 26, 1988

[54] DOOR KNOB LOCK MONITORING ALARM MECHANISM

[76] Inventors: Jeffery J. Quenneville, 3319 Edward Ave., Santa Clara, Calif. 95050; Edmond N. Quenneville, 5012 Adair Way, San Jose, Calif. 95124; Israel A. Macias, 966 Azalea Dr., Sunnyvale, Calif. 94086

[21] Appl. No.: 900,795

[22] Filed: Aug. 27, 1986

[51] Int. Cl.[4] ..... G08B 13/08; G08B 21/00

[52] U.S. Cl. ..... 340/542; 70/441

[58] Field of Search ..... 340/542; 70/441, 432

[56] References Cited

U.S. PATENT DOCUMENTS

| | | | |
|---|---|---|---|
| 3,643,249 | 2/1972 | Haywood | 340/542 |
| 3,866,164 | 2/1975 | Peterson | 340/542 |
| 4,178,587 | 12/1979 | Jamison | 340/542 |
| 4,196,422 | 4/1980 | Swigert et al. | 340/542 |
| 4,450,434 | 5/1984 | Nielson et al. | 340/506 |
| 4,453,390 | 6/1984 | Moritz et al. | 70/434 |
| 4,465,997 | 8/1984 | Hines | 340/542 |
| 4,516,114 | 5/1985 | Cook | 340/542 |
| 4,559,796 | 12/1985 | De Forrest, Sr. | 70/432 |
| 4,683,741 | 8/1987 | Fields | 70/432 |

OTHER PUBLICATIONS

Editors of *Science & Mechanics, Complete Handymen Do-It-Yourself Encyclopedia,* pp. 69–72, H. S. Stuttman Co., New York, N.Y., 1975.

*Primary Examiner*—Glen R. Swann, III

*Attorney, Agent, or Firm*—Rosenblum, Parish & Bacigalupi

[57] ABSTRACT

An interior door knob for conventional lockable door latches includes a hollow knob with a cylindrical neck having conventional means for engaging and rotating the latch spindle to mechanically move the door bolt and an actuator mechanically engaging the locking mechanism of the door latch and extending through the cylindrical neck into the housing and being movable between a first and a second position. A battery, an acoustic/visual indicating means and a normally-open microswitch electrically connected in series are mounted in a component module received within the knob housing. The microswitch switches responsive to the position of the actuator for indicating when the locking mechanism of the door latch is not locked.

9 Claims, 6 Drawing Sheets

DOOR KNOB LOCK MONITORING ALARM MECHANISM

BACKGROUND OF THE INVENTION

1. Field of the Invention

This invention relates to mechanisms for indicating the status of the locking mechanism of a conventional locking door latch mechanism and more particularly, to a replacement interior doorknob having a self contained battery energized audio and/or visual indicating means sensing whether the locking mechanism which prevents the exterior knob from turning is disengaged.

2. Description of the Prior Art

Alarm systems for indicating the locked or unlocked status of a door or other movable partition closing an entryway are common and well known. Such alarm systems can be divided into several common categories.

The mechanisms in the most common category typically include a mechanism which electrically or otherwise senses the position of a bolt securing the door or other partition across the entryway. For example, U.S. Pat. No. 4,178,587, F. W. Jamison, describes a system for sensing the engaged position of a bolt involving a small "normally-closed" (micro)switch which is held in an open position by the bold in its engaged or locked position. Dislodging or disengaging the bolt allows the "normally-closed" switch to close, completing an electrical circuit which includes a source of electrical energy and an electrically energized indicating means such as a buzzer or light. Various different types of switching mechanisms for sensing the presence or absence of a bolt securing a door or partition across an entry way are described in U.S. Pat. No. 4,465,997, T. N. Hines.

Another common category of alarm systems senses whether or not the door or partition closing the entryway is ajar. Probably the most common type of alarm system in this latter category includes a magnetically energized "normally-open" reed switch located on the stationary door frame and held closed by a magnet mounted on the moving door or partition when the door is closed. When the door or partitioned is moved, moving the magnet away from the reed switch, the reed switch opens, thereby interrupting an electrical circuit and triggering an alarm circuit which typically includes a source of electrical energy and an electrically energized audio and/or visual alarm indicator. Alarm systems of this latter category are typically utilized for the purpose of detecting unauthorized entry. A variation of the above system is described in U.S. Pat. No. 4,516,114, R. C. Cook.

Other categories of lock monitoring alarm systems include optical sensors and magnetic switches, as well as small electrical microswitches for sensing a combination of different parameters relative to a locked door or partition closing a entryway. For example, U.S. Pat. No. 4,453,390, P. G. Moritz, et al, describes a combination lock monitoring system which involves the use of photosensitive means responding to light reflecting off of particular areas of both a lock bolt mechanism and a lock drop arm, in combination with one or more "normally-open" microswitches closing responsive to closure of a partition and engagement of a time lock mechanism.

Summarizing, while there are many different types of monitoring systems for providing an alarm indicating that a door or partition is unlocked, such systems typically require components mounted in both the frame of the entryway and the door. Additionally, existing lock monitoring alarm systems require an electrical connection between a switching mechanism and an external electrical energizing and alarm circuit. Consequently, such systems are typically mounted in the frame of the portal rather than in the moving door or partition.

The primary disadvantage of existing lock monitoring alarm systems is the necessity for electrical wiring coupling a switching mechanism into an alarm circuit. This limitation has discouraged use of such systems by the general public except in those instances where the risk of loss economically justifies installation of such a system. For example, with existing systems it has not been considered feasible to retrofit each door of a hotel equipped with common lockable door latching mechanisms with lock monitoring alarm systems.

Furthermore, such lock monitoring alarm systems have not been considered economically feasible for doorways between rooms in a common structure wherein a manually actuated locking mechanisms are incorporated into the interior knob for engaging and releasing a locking mechanism preventing the exterior knob from turning, e.g. a bathroom door.

Finally, externally wired lock monitoring systems have simply not been accepted by the general public for use in their residual dwellings. The doorways of such dwellings typically include one or more lockable door latching mechanisms with turnable exterior and interior knobs engaging a spindle moving the door bolt. Typically, such residential door latching mechanisms include an exterior key activated mechanism, often incorporated into the exterior knob for operating a locking mechanism located within the frame of the door preventing rotation of the exterior knob, and an interior manually operable mechanism for engaging and releasing the locking mechanism.

SUMMARY OF THE INVENTION

An interior door knob is described which includes, within its hollow body, an electrically energized circuit including a battery, a normally-open microswitch, and an electrically energized audio and/or optical indicator electrically connected in series for monitoring the status of locking mechanisms in conventional lockable door latches. The microswitch is positioned within the knob housing such that a camming surface associated with an actuator which moves responsive to engagement and release of the locking mechanism closes the microswitch when the locking mechanism is in the release state for electrically energizing the audio and/or optical alarm indicators signaling that the door is not locked.

A particular embodiment of the invented self-contained, interior door knob lock monitoring alarm system includes a remote (external) pick-up responding to a unique acoustical/optical signal emitted from the door knob when the key activated exterior mechanism causes movement of the interior, manual actuator. This embodiment is responsive to a change in state of the locking mechanism, to provide an intrusion alarm at the remote location.

In other embodiments, replacement interior door knobs for the most common types of lockable door latching mechanisms are described, each having a door knob housing adapted to mechanically engage/operate a particular type of spindle of the more common types of lockable door latches. In each of the different embodiments, the knob housing has a cylindrical receptacle receiving a removable component module containing the electrical components of the system. Some of the replacement door knobs also include coaxial, manually rotatable actuators which replace the existing interiorly operated manual actuator mechanisms and provide the camming surface for switching the microswitch.

The advantages, objects, features and aspects of inventive door knob lock monitoring alarm system will become apparent and are more fully described with reference to the following description and drawings of preferred and exemplary embodiments of the system.

*KWIKSET is a trademark of Emhart Industries, Inc. Farmington Ct.

Figures 1, 2, 2A, 2B:
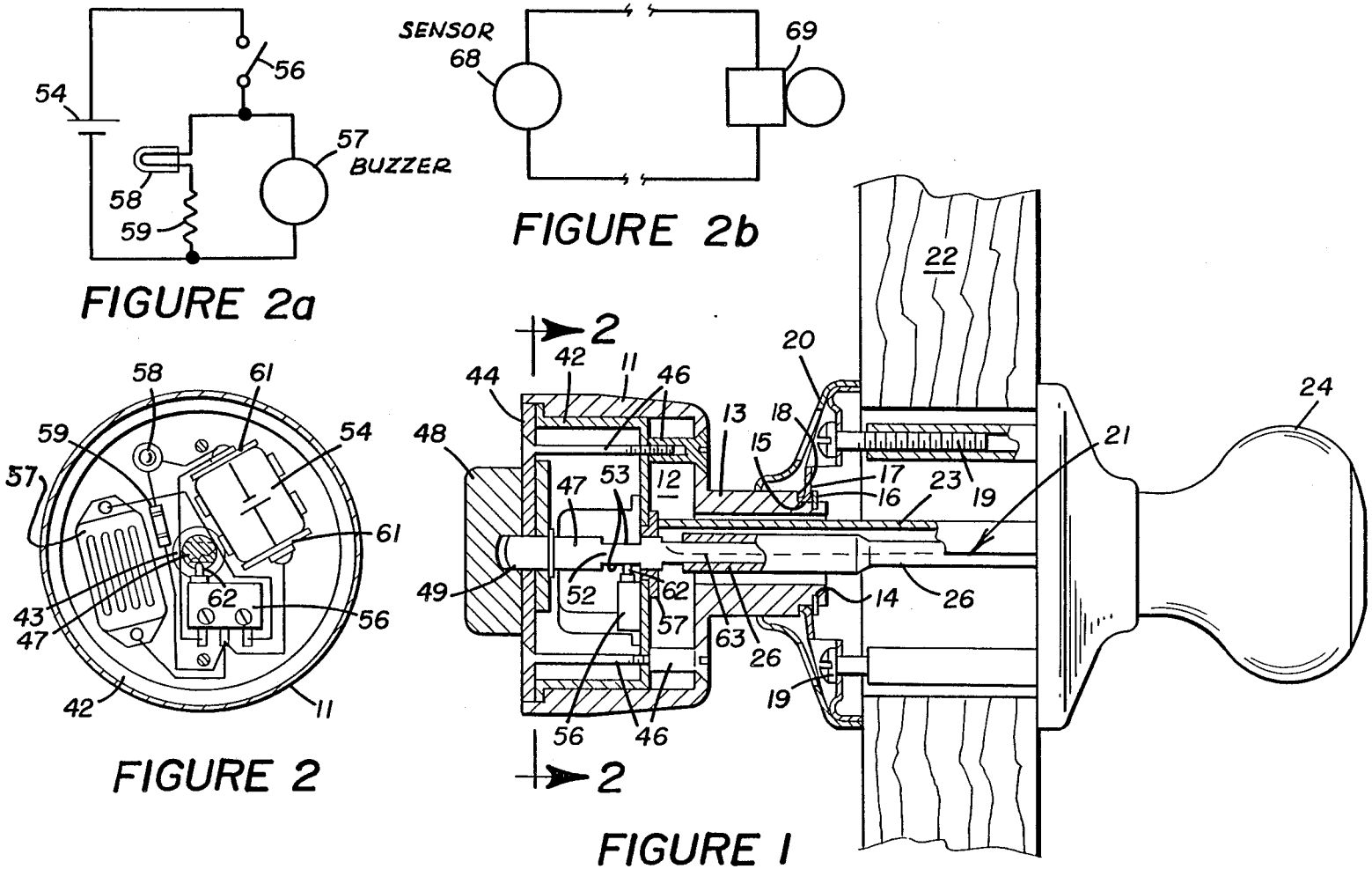
FIG. 1 is a partial cross-section, side elevation view showing the components of an interior door knob with a lock monitoring alarm system of this invention in a first embodiment adapted for a typical KWIKSET* door latching system.

FIG. 2 is a cross-section view taken along reference plane 2—2 of the embodiment shown in FIG. 1.

FIGS. 2*a* and 2*b* are simple schematic diagrams of the electrical components of the lock monitoring alarm system.

Figure 3:
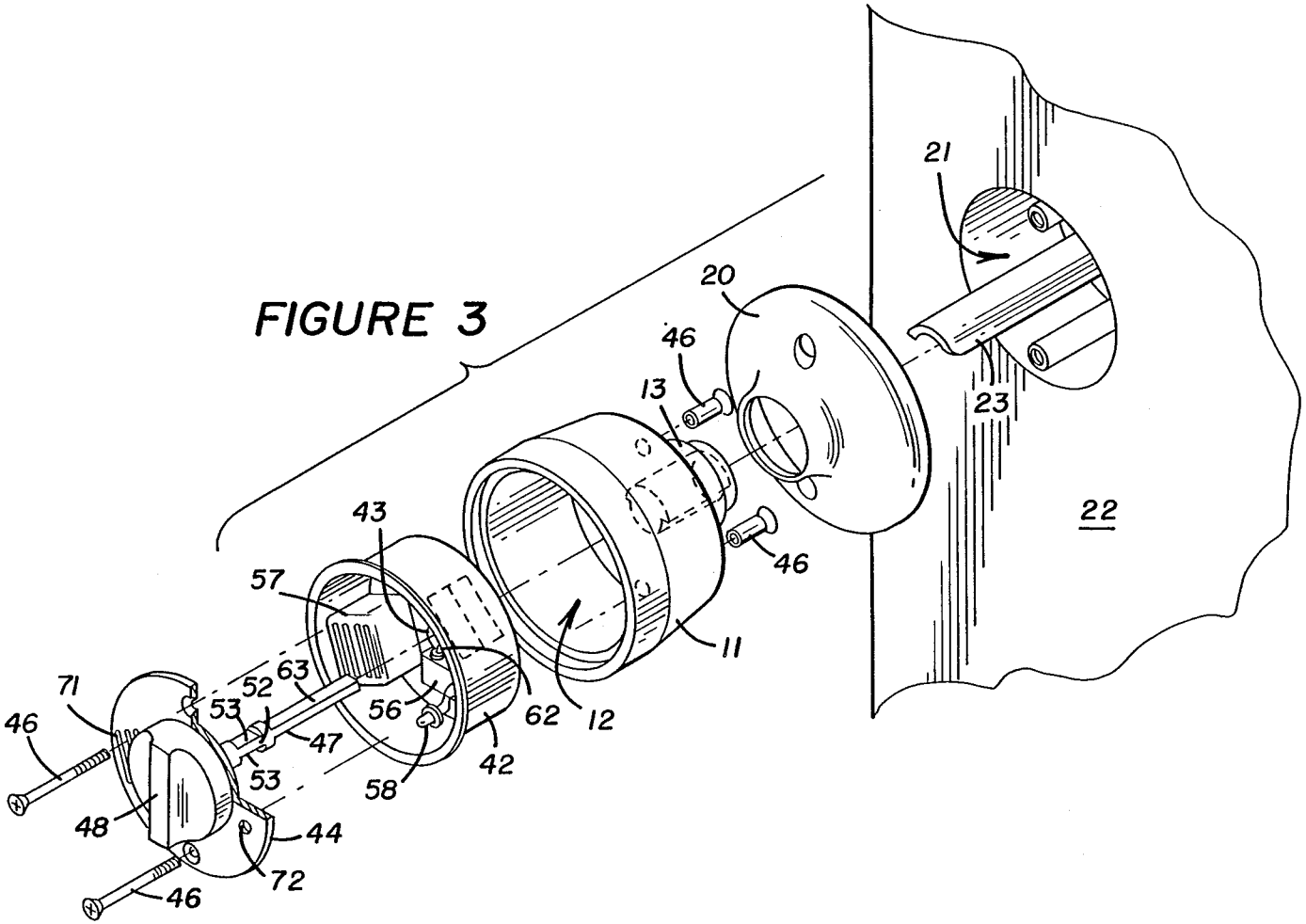

FIG. 3 is an exploded perspective view of the interior door knob lock monitoring alarm system shown in FIG. 1.

Figure 4:
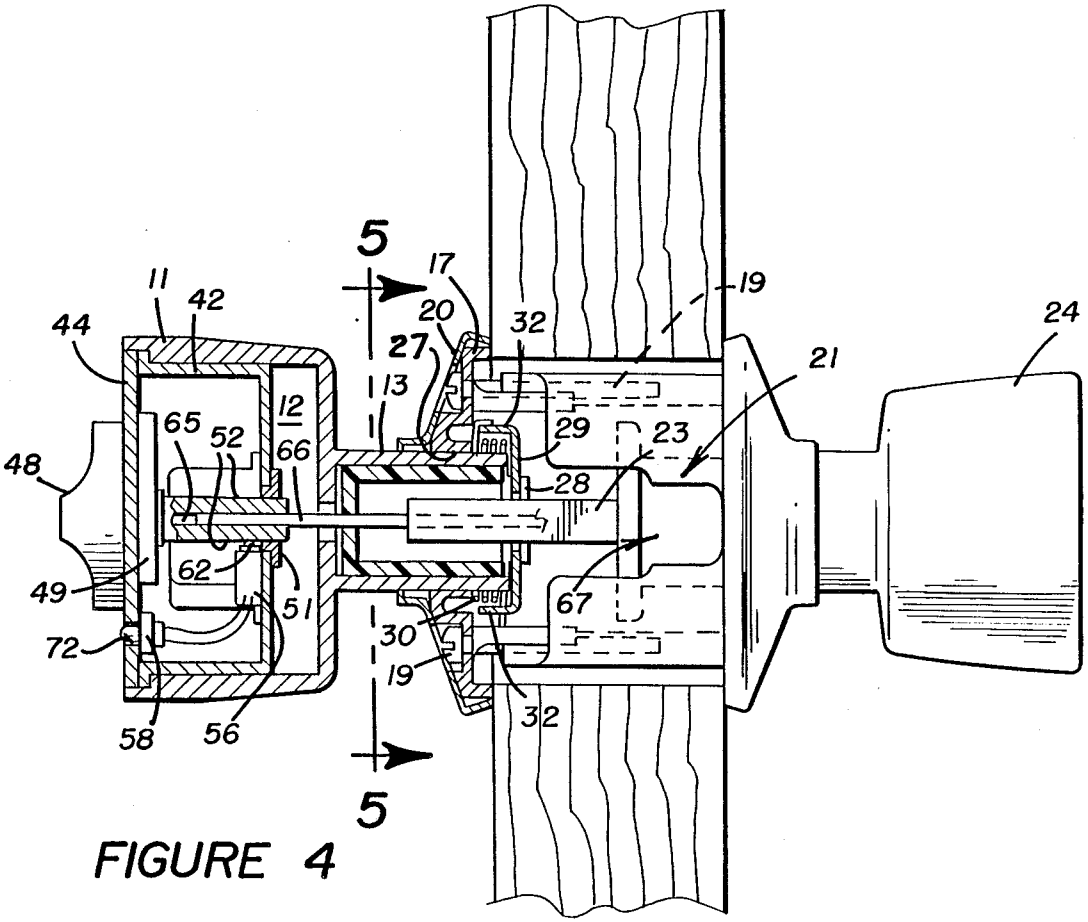

FIG. 4 is a partial cut away side elevation view of a second embodiment of an interior door knob with a lock monitoring alarm system for a typical SCHLAGE** door latch.

**SCHLAGE is a trademark of Schlage Lock Company of San Francisco, Ca.

Figure 5:
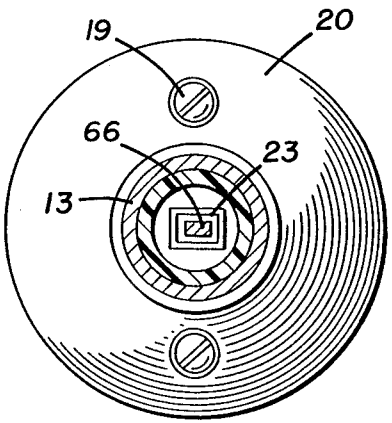

FIG. 5 is a cross-section view taken along reference plane 5—5 of the embodiment shown in FIG. 4.

Figure 6:
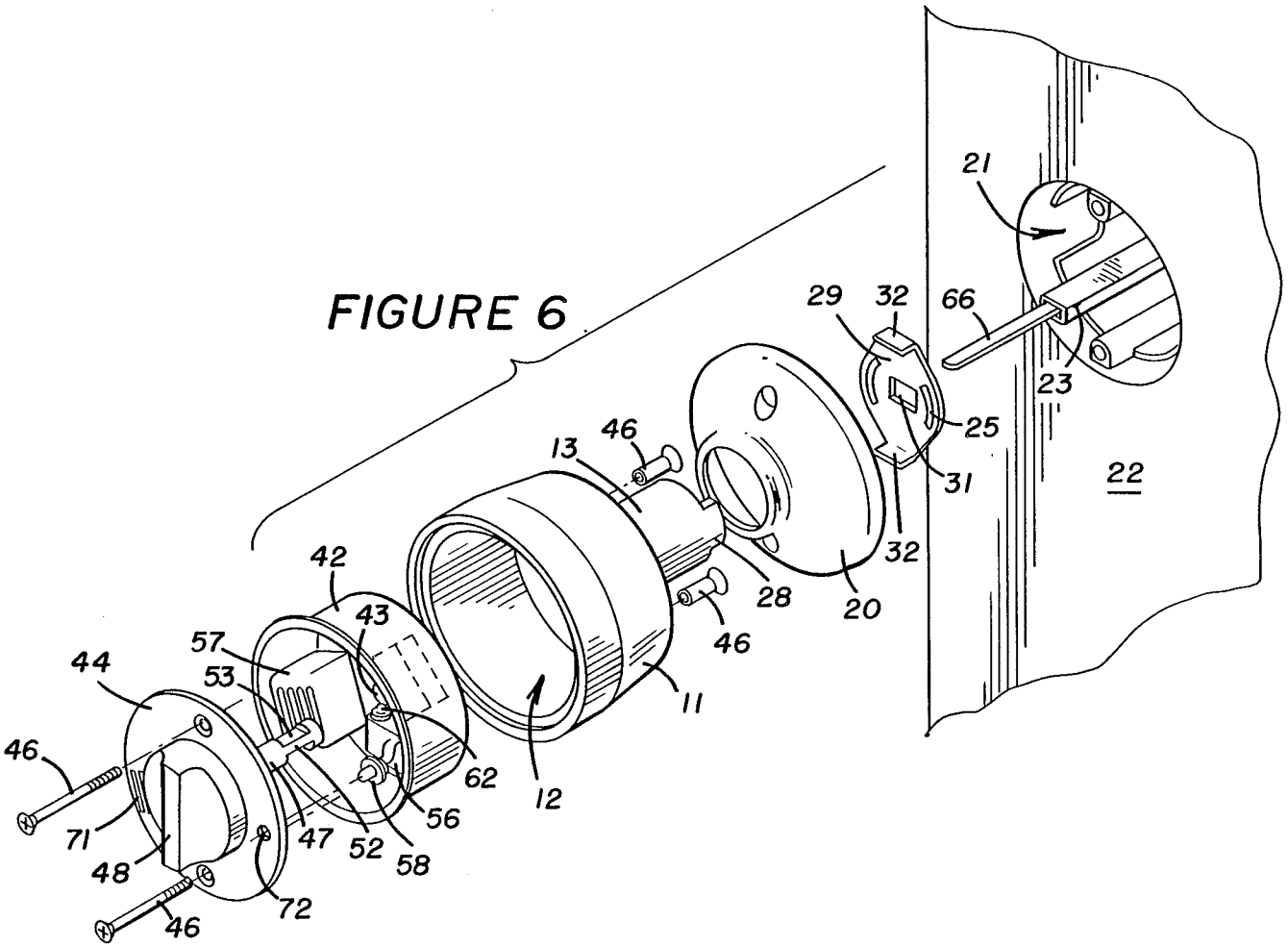

FIG. 6 is an exploded perspective view of the embodiment shown in FIG. 4.

Figure 7:
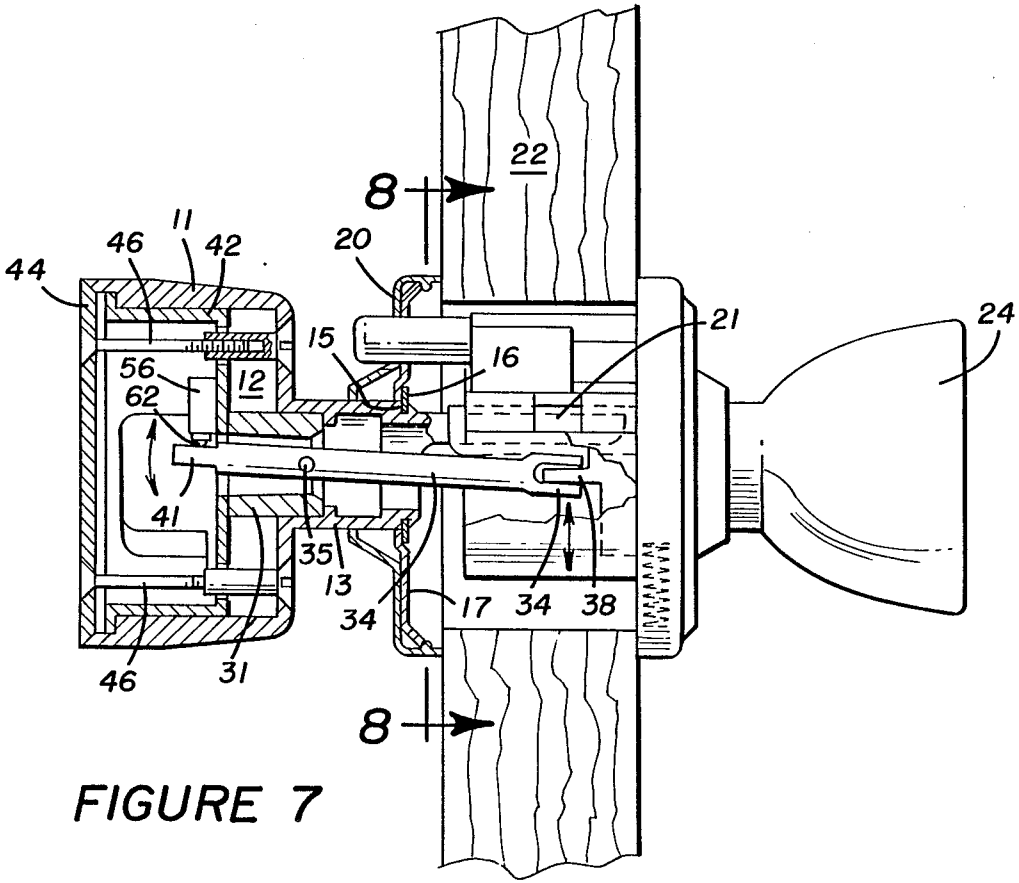

FIG. 7 is a partial cut away side elevational view of an interior door knob with a lock monitoring alarm system in a third embodiment adapted for a typical WESLOCK*** locking door latch.

***WESLOCK is a trademark of TRE Corporation of Beverly Hills, Ca.

Figure 8:
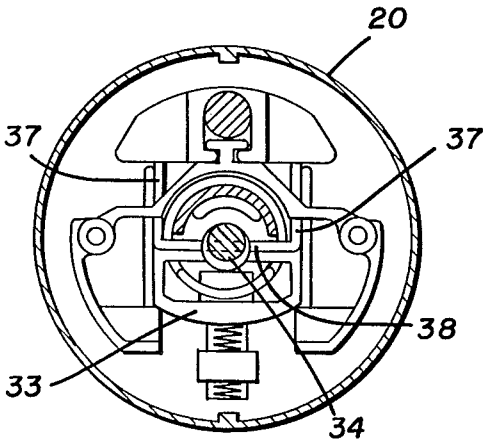

FIG. 8 is a cross-section view taken along reference plane 8—8 of FIG. 7.

Figure 9:
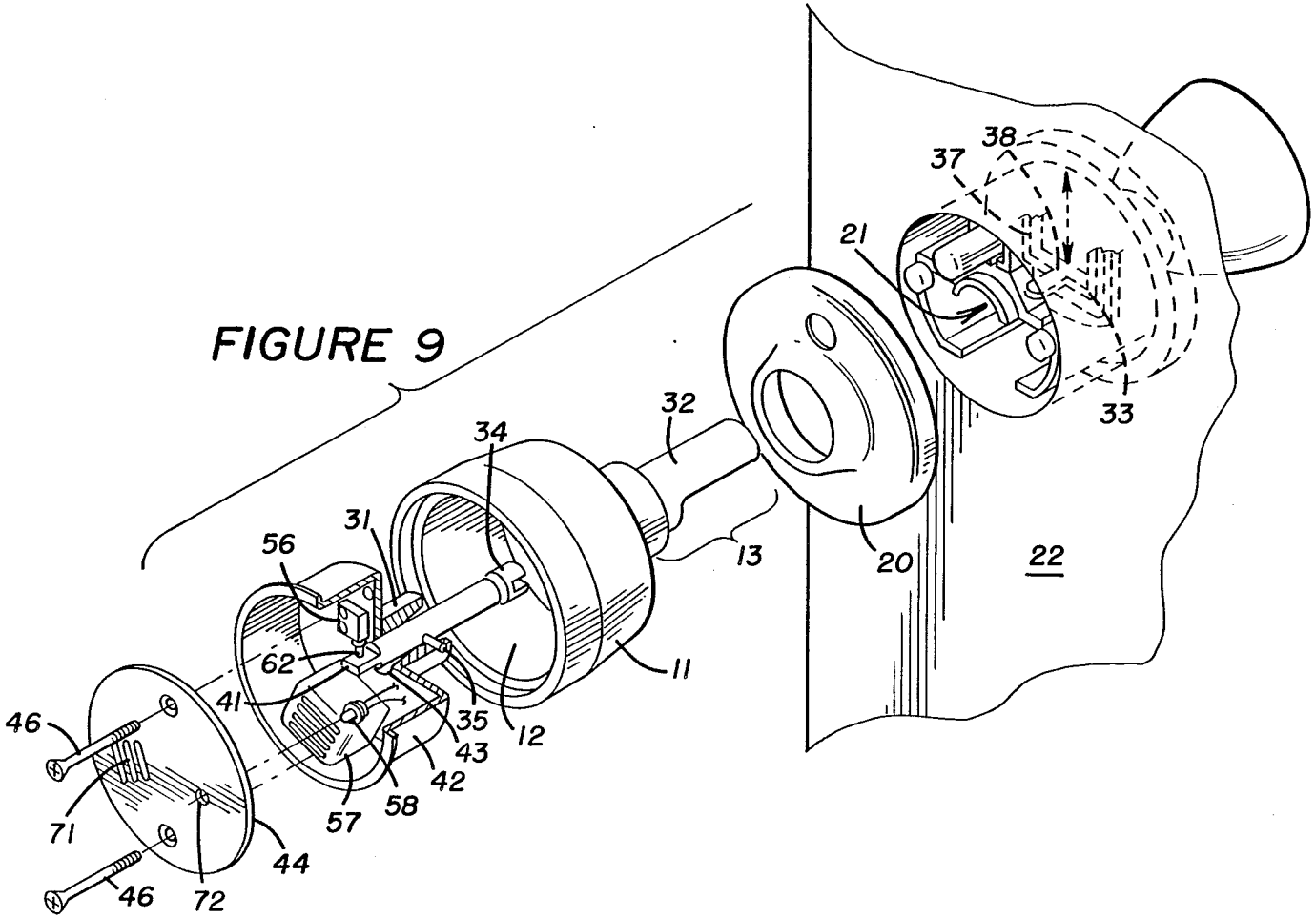

FIG. 9 is an exploded perspective view of the components of the embodiment shown in FIG. 7.

DESCRIPTION OF PREFERRED AND EXEMPLARY EMBODIMENTS

With reference to FIGS. 3, 6 and 9, the mechanical elements of an interior door knob with a self-contained lock monitoring alarm system include a hollow knob housing 11 with a component receptacle 12 and an extending cylindrical neck 13, an electrical component mounting module 42 with a central aperture 43 and adapted to be received within the component receptacle 12, a cap 44 securable across the open end of the hollow knob housing 11 by fasteners 46 enclosing the electrical components within the hollow knob 11, an actuator member 47 including camming surfaces 52 and 53 engaging/replacing the conventional manual lock actuator/mechanism of the door latch 21, and a normally-open microswitch 56 with a sensor button 62 positioned for engagement with the camming surfaces 52 and 53 of the actuator member 47.

Referring to FIGS. 2, 2*a*, and 2*b*, the electrical component of the lock monitoring alarm system include a battery 54, the normally open microswitch 56, a buzzer 57 and a light-emitting-diode (LED) 58. A resistor 59 is electrically connected in series with the LED 58. A remote acoustic and/or optical sensor 68 can be positioned away from the door 22 within the room sought to be secured for sensing acoustical emissions of the buzzer 57 and/or optical emissions of the LED 58. Sensor 68 is provided with a power source to form a complete circuit which closes in response to acoustical and/or optical emissions. Upon receiving either the acoustical or the optical emission, the remote sensor 68 would activate an alarm 69 at a remote location.

Referring to FIGS. 1, 4, & 7, the hollow cylindrical neck 13 coaxially extending from the knob housing 11 is both externally and internally configured and adapted to engage a particular type of spindle for a particular type of door latch.

For example, the neck 13 of the knob housing 11 depicted in FIGS. 1–3 includes an exterior annular slot 14 for accommodating a lock ring 16. A mounting plate 17 journals the neck 13 of the knob 11 on a bearing surface 15 defined between the lock ring 16 and a raised annular shoulder 18. The mounting plate 17 is secured by conventional screws 19 to the latching mechanism indicated generally at 21 mounted within the body of a door 22. As indicated in FIG. 3, the internal configuration of the neck 13 is shaped to accommodate a half cylindrical spindle 23 which engages and moves the bolt of the latch when either the interior knob housing 11 or exterior knob 24 is turned. The internal configuration of the knob neck 13 is also shaped to accommodate a central coaxial actuator element 26. A decorative cover surface 20 covers the mounting plate 17.

In the embodiment shown in FIGS. 4–6, the neck 13 of the knob housing 11 is adapted to be journaled by a cylindrical bearing surface 27 provided by the mounting plate 17. A conventional torsion spring 30 is disposed around the dista end of the cylindrical neck 13. As shown in FIG. 6, the distal end of the knob neck 13 includes extending dogs 28 adapted to be secured in correspondingly shaped slots 25 of a spindle engagement plate 29. The spindle engagement plate 29 has a square orifice 31 adapted to received a hollow square spindle 23 operating the door bolt of the latch mechanism 21. The ears 32 of the spindle engagement plate 29 engage the anchored ends of the torsion spring 30 in the conventional matter of supplying the necessary torque for operating the door latch 21 upon release of the door knob 11 rotating the spindle 23 to extend the door bolt for capture by a conventional strike plate mounted in the conventional manner within a door jam as the door closes.

Except in those cases where details of the latch mechanisms 21, the locking mechanisms, the door bolt mechanisms, the exterior door knobs 24 and the cooperation between the spindles 23 and the door bolt mechanisms are considered essential to the understanding of the invention, they are not shown in the Figures nor described in any detail otherwise.

In the embodiment shown in FIGS. 7–9, the knob neck 13 extends coaxially from the housing 11 and is adapted to be journaled by a cylindrical bearing surface 15 provided by the mounting plate 17 in much the same manner as the embodiment shown in FIG. 1. In this embodiment, the distal end 32 of the neck 13 extends as a half cylinder into the latch mechanism 21 where it is received within a cooperating structure for moving the door bolt when the knob 11 is turned. The half cylindrical end 32 also disengages a locking element 33 in the latch mechanism 21 when the interior knob 11 is turned. The locking element 33 prevents the exterior knob 24 from turning. A cylindrical sleeve 31 is received within the hollow knob neck 13 incorporating a toggle actuator 34 pivoting on a pin 35 secured diametrically across the sleeve. The sleeve 31 is dimensioned such that it is loosely received within the knob neck 13 so that it does not rotate when the knob 11 is turned. One end of the toggle actuator 34 is mechanically coupled to the locking member 33 in a conventional manner.

As shown in FIG. 8, the locking member 33 is essentially a yoke with extending legs 37 and a central crossbar 38. The distal end of the toggle 34 is coupled to the crossbar 38. When the locking member moves between its locked and unlocked positions, it pivots the toggle actuator 34 causing its remaining end 41 extending into the hollow cavity of the knob 11 to move oppositely.

As shown in FIGS. 1–4, 6, 7 & 9, the electrical component module 42 comprises a removable cylindrical cup adapted to be received within the hollow knob housing 11. The aperture 43 drilled through the bottom of the module 42 is coaxial with the the knob neck 13 when the module 42 is received within the knob housing 11.

It should be appreciated that the modules 42 are interchangeable between different embodiments of knobs 11. In fact, it is feasible to pot the electrical components within the module 42 with an appropriate material to provide additional mechanical stability, electrical isolation and security from tinkering. Finally, the module could be disposable.

A cap 44 is secured across the open end of the hollow knob housing 11 by fasteners 46 enclosing the component module within the knob housing 11. In the embodiments shown in FIGS. 1–6, one end of the actuator member 47 extends coaxially thorough the cap 44 and is journaled for rotation by bearing surfaces 49 and 51 associated with the cap 44 and module 42 respectively. A thumb boss 48 graspable between the thumb and forefinger of the human hand is secured to the end of actuator 47 extending through the cap 44.

Referring to FIG. 2, a battery 54 is removably held within the module 42 by conventional contacting brackets 61. The microswitch 56 is positioned and mounted on the bottom of the module 42 proximate the aperture 43. The buzzer 57 and LED 58 are also located within the module 42. A grill aperture 71 and a LED mounting port 72 for receiving the tip of the LED 58 are cut thorough cap 44 to allow for perception of the acoustic and optical emissions of the buzzer 57 and LED 58.

Suitable electrical components for lock monitoring alarm system include the following:

| | |
|---|---|
| Buzzer: | J4-814, 3VDC 70DB MIN output level at three feet, 15 ma ± 2 standard current at 400 HZ, frequency. |
| Micro switch | L45A 250 vac OFF/ON Switch |
| LED | ?? |
| Resistor | 100 OHMS |
| Battery | 2.7 v, (E.G. EVERYREADY ENERGIZER NO. EXP14-2.7 v). |

The sensor button 62 of the microswitch 56 includes a conventional spring return mechanism causing the button to return. As shown in FIGS. 1, 2, 4 and 7, the sensor button 62 of the microswitch 56 extends radially towards the central turning axis of the knob housing 11 and is positioned such that it will be depressed by the camming surface 52 and not depressed by the relief camming surface 53 of the actuator 47 as it rotates.

With reference to the embodiment shown in FIGS. 7–9, the sensor button 62 of the microswitch 56 extends when the locking element 33 is in the locked or engaged position. Conversely, when the locking member 33 is disengaged, the end 41 of the toggle actuator 34 pivots depressing the sensor button 62.

In the embodiment shown in FIGS. 1–3, the actuator 47 includes a squared end section 63 which coaxially extends from the component module 42 through the knob neck 13 and is received by a square receptacle of the locking mechanism indicated generally at 21. Accordingly, the locking mechanism 66 can be operated by manually turning the thumb boss 48 which rotates the actuator 47.

In the embodiment shown in FIGS. 4–6, the actuator member 47 includes a hexahedral coaxial receptacle shaped to receive an extending rectangular turn-rod 66 which mechanically operates the lock mechanism indicated generally at 67. Accordingly, the locking mechanism 67 can be operated by manually turning the thumb boss 48 which rotates the actuator 47.

Of course, in the embodiments of FIGS. 1–6, turning the knob 48 also rotates the actuator camming surfaces 52 and 53 alternatively depressing and releasing the sensor button 62 of the microswitch 56. More particularly, referring to FIGS. 1 and 4, the microswitch button 62 is depressed by camming surface 52 when the lock mechanism indicated generally at 67 is disengaged (unlocked) as illustrated in FIG. 4, and not depressed relief surface 53 when the lock mechanism 67 is engaged (locked) as illustrated in FIG. 1.

Various modifications of the described self contained door knob lock monitoring alarm system and its essential components maybe made by those skilled in the art without departing from the spirit and the scope of the invention as described and presented in the following claims:

We claim:

1. In a lockable door latch having turnable exterior and interior knobs for mechanically rotating a spindle for moving a door bolt in and out of engagement with a strike plate mounted in a door jamb, and having a manually operated interior mechanism for locking and releasing a locking mechanism, an interior knob incorporating a lock monitoring alarm comprising in combination, a knob housing having a cylindrical receptacle and an integral cylindrical neck coaxially extending therefrom, the cylindrical neck including means for engaging and mechanically rotating the spindle when the knob housing is turned, an actuator member extending from within the knob housing, through the cylindrical neck of the knob housing for mechanically engaging the locking mechanism, the actuator member being mechanically moved between a lock position and an unlock position as the locking mechanism engages and disengages respectively, a source of electrical energy located within the knob housing having at least a pair of terminals, each electrically insulated from the other, a normally-open electrical switching means located within the knob housing and mechanically coupled to the actuator member for opening and closing responsive to the lock and unlock positions of the actuator member, respectively, an electrically energized indicator means located within the knob housing for generating a signal perceptible to a human being upon being energized with electrical energy, electrical current conductor means for electrically connecting the switching means and the indicator means in series between the terminals of the electrical energy source, whereby the indicator means is energized when the switching means is closed.

2. The door knob of claim 1 and further including a removable circular cap member having a closure surface for closing the cylindrical receptacle of the knob housing.

3. The door knob of claim 2 wherein the locking mechanism of the door latch is engaged and disengaged by rotating the actuator member, and the actuator member comprises a rod with an end extending through the removable cap, and further including, a thumb-finger graspable knob secured to the extending end of the actuator member, whereby the actuator member can be manually rotated for engaging and disengaging the locking mechanism, and wherein the actuator member has a first camming surface and a second camming surface oriented in rotational sequence around the actuator rod, the first camming surface having a greater radial height than the second camming surface, and wherein the normally-open electrical switching includes cam following means engaging and following the cam surfaces of the actuator as the actuator rotates between the lock position corresponding to the first camming surface for mechanically closing the switch and the unlock position corresponding to the second camming surface for mechanically opening the switch.

4. The door knob of claim 1 wherein the electrically energized indicator means comprises a buzzer for generating an audio output of at least 70 db at a frequency perceptible by human beings.

5. The door knob of claim 1 wherein the electrically energized indicator means comprises a light emitting diode having an optical emission perceptible by human beings.

6. The door knob of claim 2 wherein the electrically energized indicator means comprises a buzzer for generating an audio output of at least 70 db at a frequency perceptible by human beings and a light emitting diode having an optical emission perceptible by human beings, and wherein the removable circular cap member includes an audio grill port and an optical port communicating through its closure surface.

7. The door knob of claim 1 wherein the locking mechanism of the door latch is engaged and disengaged by a yoke mechanism translating perpendicularly relative to an axis coaxial with the spindle, and wherein the actuator member comprises a toggle rod mechanically coupled at one end to the yoke mechanism, its remaining and extending into the receptacle of the knob housing, and further including, a cylindrical sleeve received within the neck of the knob housing, a pivot pin located diametrically across the cylindrical sleeve securing the toggle rod whereby translation of the yoke mechanism between its engaged and disengaged positions pivots the remaining end of the rod within the receptacle of the knob housing between the lock and the unlock positions, respectively, and wherein, the normally-open electrical switching means includes a spring return sensor button mechanism for establishing an electrical connection when depressed mounted and positioned within the receptacle of the knob housing such that its sensor button is depressed by the remaining end of the rod when it is at the unlock position.

8. An interior door knob incorporating a lock monitoring alarm comprising in combination, an interior knob housing having a cylindrical receptacle and an integral cylindrical neck coaxially extending therefrom, the cylindrical neck including means for engaging and mechanically rotating a spindle opening a lockable door latch when the knob housing is turned, an actuator member extending from within the knob housing, through the cylindrical neck of the knob housing and mechanically coupled to a locking mechanism within the lockable door latch for preventing rotation of the spindle by an interior knob, the actuator member being mechanically moved between a lock position and an unlock position as the locking mechanism engages and disengages respectively, a source of electrical energy located within the interior knob housing having at least a pair of terminals, each electrically insulated from the other, a normally-open electrical switching means located within the interior knob housing and mechanically coupled to the actuator member for opening and closing said switching means responsive to the lock and unlock positions of the actuator member, respectively, electrically energized indicator means located within the interior knob housing for generating an audio output of at least 70 db at a frequency perceptible by human beings and for generating a light emission perceptible by human beings upon being energized with electrical energy, electrical current conducting means for electrically connecting the switching means and the indicator means in series between the terminals of the electrical energy source, whereby the indicator means is energized when the switching means is closed, a removable circular cap member closing the cylindrical receptacle of the knob housing and having an audio grill port and an optical port communicating through its closure surface.

9. The interior door knob of claim 6 or 8 further including a cylindrical component module having a central passageway, and wherein the normally-open electrical switching means, the source of electrical energy, the electrically energized indicator means and the electrical current conducting means are each secured and positioned within the module, the module being interchangeably receivable in the receptacles of a plurality of different interior knob housings.

* * * * *